US011781758B2

(12) United States Patent
Bradford et al.

(10) Patent No.: US 11,781,758 B2
(45) Date of Patent: Oct. 10, 2023

(54) WINDOW-MOUNTED CLIMATE CONTROL SYSTEM AND METHOD

(71) Applicant: Treau, Inc., San Francisco, CA (US)

(72) Inventors: Kipp Bradford, Pawtucket, RI (US); Kas DeCarvalho, Providence, RI (US); Thomas Brendler, Providence, RI (US)

(73) Assignee: TREAU, INC., San Francisco, CA (US)

( * ) Notice: Subject to any disclaimer, the term of this patent is extended or adjusted under 35 U.S.C. 154(b) by 0 days.

(21) Appl. No.: 17/948,524

(22) Filed: Sep. 20, 2022

(65) Prior Publication Data

US 2023/0013389 A1 Jan. 19, 2023

Related U.S. Application Data

(63) Continuation of application No. 16/987,735, filed on Aug. 7, 2020, which is a continuation of application No. 12/724,036, filed on Mar. 15, 2010, now Pat. No. 10,775,054.

(60) Provisional application No. 61/159,960, filed on Mar. 13, 2009.

(51) Int. Cl.
*F24F 1/0003* (2019.01)
*F24F 1/32* (2011.01)
*F24F 1/34* (2011.01)

(52) U.S. Cl.
CPC ..... *F24F 1/0003* (2013.01); *F24F 1/32* (2013.01); *F24F 1/34* (2013.01); *F24F 2221/36* (2013.01)

(58) Field of Classification Search
CPC ..... F24F 1/0003; F24F 1/34; F24F 2221/36
See application file for complete search history.

(56) References Cited

U.S. PATENT DOCUMENTS 2,320,436 A 6/1943 Hull
2,436,713 A 2/1948 Cody
2,895,699 A 7/1959 Lidsky
(Continued)

FOREIGN PATENT DOCUMENTS

CA 2409963 A1 5/2003
EP 1779965 A2 5/2007
(Continued)

OTHER PUBLICATIONS

International Search Report and Written Opinion dated Nov. 26, 2020, Patent Application No. PCT/US2020/050199, 7 pages.
(Continued)

*Primary Examiner* — Ana M Vazquez
(74) *Attorney, Agent, or Firm* — Davis Wright Temaine LLP

(57) ABSTRACT

A climate control system coupled within an opening of a structure, with the opening separating an internal area within the structure and an exterior area external to the structure, the climate control system straddling the opening. The climate control system includes: an interior unit disposed at the opening within the internal area; an exterior unit disposed at the opening in the exterior area; and a connector between the interior unit and the exterior unit that extends through the opening, the connector including: a circulation hose that extends through the opening to connect the exterior unit and the interior unit, and a controls system configured to operate the interior unit and the exterior unit.

17 Claims, 6 Drawing Sheets

(56) References Cited

U.S. PATENT DOCUMENTS

| | | | | |
|---|---|---|---|---|
| 3,176,474 | A * | 4/1965 | Abbott | F24F 1/0003 62/262 |
| 3,491,549 | A | 1/1970 | Oglesby | |
| 3,505,321 | A * | 4/1970 | Hoffmeister | C07D 295/12 544/380 |
| 3,554,476 | A | 1/1971 | Gaylor, Jr. | |
| 3,847,211 | A | 11/1974 | Fischel et al. | |
| 4,393,662 | A | 7/1983 | Dirth | |
| 4,407,358 | A | 10/1983 | Muellejans et al. | |
| 4,440,639 | A | 4/1984 | Galuska | |
| 4,641,503 | A | 2/1987 | Kobayashi | |
| 4,809,516 | A | 3/1989 | Jones | |
| 5,027,614 | A | 7/1991 | Mori et al. | |
| 5,167,131 | A | 12/1992 | Karkhanis | |
| 5,245,835 | A | 9/1993 | Cohen et al. | |
| 5,355,688 | A | 10/1994 | Rafalovich et al. | |
| 5,445,213 | A | 8/1995 | Im | |
| 5,467,812 | A | 11/1995 | Dean et al. | |
| 5,507,337 | A | 4/1996 | Rafalovich et al. | |
| 5,582,025 | A | 12/1996 | Dubin et al. | |
| 5,682,752 | A | 11/1997 | Dean | |
| 6,138,987 | A | 10/2000 | Lee | |
| 6,286,316 | B1 | 9/2001 | Waldrop et al. | |
| 6,318,108 | B1 | 11/2001 | Holstein et al. | |
| 6,343,482 | B1 | 2/2002 | Endo et al. | |
| 6,389,834 | B1 | 5/2002 | LeClear et al. | |
| 6,482,332 | B1 | 11/2002 | Malach | |
| 6,525,505 | B2 | 2/2003 | Bay et al. | |
| 6,840,056 | B2 | 1/2005 | Tanaka | |
| 6,983,621 | B2 | 1/2006 | Cur et al. | |
| 7,121,105 | B1 | 10/2006 | Rais | |
| 8,281,614 | B2 | 10/2012 | Koo et al. | |
| 9,303,895 | B1 | 4/2016 | Grant | |
| 10,012,450 | B2 | 7/2018 | Riendeau | |
| 10,401,043 | B2 | 9/2019 | Li | |
| 10,775,054 | B2 | 9/2020 | Bradford et al. | |
| 10,845,133 | B2 | 11/2020 | Romanin et al. | |
| 11,143,467 | B2 | 10/2021 | Lynn et al. | |
| 11,173,575 | B2 | 11/2021 | Rutkowski et al. | |
| 11,253,958 | B2 | 2/2022 | Rutkowski et al. | |
| 2002/0026800 | A1 | 3/2002 | Kasai et al. | |
| 2003/0097854 | A1 | 5/2003 | Cur et al. | |
| 2003/0110789 | A1 | 6/2003 | Cur et al. | |
| 2005/0092474 | A1 | 5/2005 | Seidel | |
| 2006/0107683 | A1 | 5/2006 | Song et al. | |
| 2006/0157225 | A1 | 7/2006 | Martin et al. | |
| 2008/0087031 | A1 | 4/2008 | Park et al. | |
| 2009/0071181 | A1 | 3/2009 | Spanger | |
| 2010/0229585 | A1 | 9/2010 | Bradford et al. | |
| 2011/0024433 | A1 | 2/2011 | Rolland et al. | |
| 2012/0269704 | A1 | 10/2012 | Hoglund et al. | |
| 2014/0020421 | A1 | 1/2014 | Gallo | |
| 2014/0096555 | A1 | 4/2014 | Ayub et al. | |
| 2016/0043694 | A1 | 2/2016 | Price | |
| 2016/0216039 | A1 | 7/2016 | Bergin et al. | |
| 2016/0341498 | A1 | 11/2016 | Lynn et al. | |
| 2017/0297768 | A1 | 10/2017 | Gamboa | |
| 2019/0107338 | A1 | 4/2019 | Romanin et al. | |
| 2020/0003505 | A1 | 1/2020 | Minamitani | |
| 2020/0124296 | A1 | 4/2020 | Baumann et al. | |
| 2020/0197844 | A1 | 6/2020 | Stednitz | |
| 2020/0222832 | A1 | 7/2020 | Holbach et al. | |
| 2020/0238451 | A1 | 7/2020 | Rutkowski et al. | |
| 2020/0238452 | A1 | 7/2020 | Rutkowski et al. | |
| 2020/0248976 | A1 | 8/2020 | Powell | |
| 2020/0356123 | A1 | 11/2020 | Sloo et al. | |
| 2021/0078118 | A1 | 3/2021 | Li et al. | |
| 2021/0190330 | A1 | 6/2021 | Martinez Galvan | |

FOREIGN PATENT DOCUMENTS

| | | | |
|---|---|---|---|
| EP | 3608007 | B1 | 2/2021 |
| JP | H01163534 | A | 6/1989 |
| KR | 100249192 | B1 * | 4/2000 |
| KR | 20010094180 | A | 10/2001 |
| KR | 10-2009-0088319 | A | 8/2009 |
| KR | 10-2020-0137311 | A | 12/2020 |
| RU | 2100733 | C1 | 12/1997 |
| WO | 2019114943 | A1 | 6/2019 |
| WO | 2022006296 | A1 | 1/2022 |

OTHER PUBLICATIONS

International Search Report and Written Opinion dated Sep. 2, 2021, Patent Application No. PCT/US2021/039932, 7 pages.

International Search Report and Written Opinion dated Feb. 20, 2023, Patent Application No. PCT/US2022/078555, 9 pages.

International Search Report and Written Opinion dated Feb. 21, 2023, Patent Application No. PCT/US2022/078561, 13 pages.

International Search Report and Written Opinion dated Feb. 22, 2023, Patent Application No. PCT/US2022/078562, 12 pages.

USPTO Office Action in U.S. Appl. No. 17/364,176 dated Jun. 15, 2023, 32 pages.

European Patent Office Search Report dated Jul. 17, 2023, Application No. 20863262, 8 pages.

* cited by examiner

WINDOW-MOUNTED CLIMATE CONTROL SYSTEM AND METHOD

CROSS-REFERENCE TO RELATED APPLICATIONS

This application is a continuation of U.S. non-provisional application Ser. No. 16/987,735, filed Aug. 7, 2020, entitled "MODULAR AIR CONDITIONING SYSTEM,", which is a continuation of U.S. non-provisional patent application Ser. No. 12/724,036, filed Mar. 15, 2010, entitled "MODULAR AIR CONDITIONING SYSTEM,", which issued as U.S. Pat. No. 10,775,054, and which claims the benefit of U.S. Provisional Application No. 61/159,960, filed Mar. 13, 2009, entitled "MODULAR AIR CONDITIONING SYSTEM." These applications are hereby incorporated herein by reference in their entirety and for all purposes.

DETAILED DESCRIPTION OF THE PREFERRED EMBODIMENTS

Figure 1:
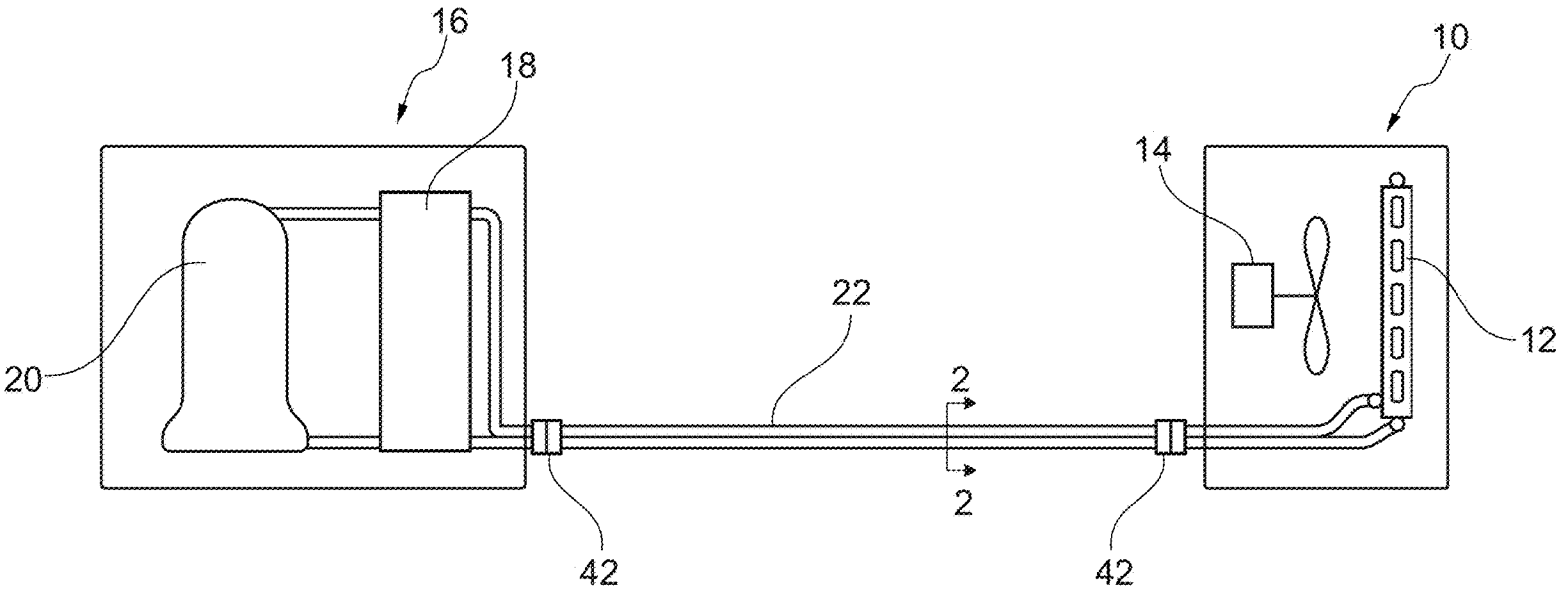
FIG. 1 is a schematic illustration of the modular climate control system of an embodiment.

The present disclosure in some aspects relates generally to modular air conditioning systems. More specifically, various embodiments relate to an air conditioning system that can be formed to include an outdoor unit and at least one indoor unit, wherein the units can be interconnected using a hose that can be user serviceable and/or modular in a manner that can allow reconfiguration and/or user serviceability.

In the prior art there is a wide variety of devices available for cooling desired locations such as a room in a home. In the most general terms, these cooling devices draw heat from the room into a coolant working fluid. Once the fluid has absorbed the heat, it is then routed to a location that is remote from the room so that the heat absorbed into the fluid can be discharged from the fluid into the remote location, typically outdoors. Such cooling devices, also known as room air conditioners, may be categorized as window air conditioners, where the unit resides in a window with the cooling unit on the interior and the heat discharge unit on the outside, split air conditioners, where the location of unit containing the air cooling unit and the heat discharging outdoor unit are separated from one another or unitary air conditioners, wherein the air cooling unit and the heat discharging outdoor unit are fixed relative to one another within a single housing.

One of the difficulties encountered with prior art window air conditioners and unitary air conditioners is noise. Since the entire unit is contained within a single housing the fans, pumps and fluid compressors are all positioned in a concentrated, self-contained unit. As a result, such units are typically noisy to operate. Further, since the heat absorbing and heat discharging units are both positioned in the same housing, accommodations need to be made with respect to positioning of the units so that they do not operate as a closed loop within the room to be cooled. This is done in the case of a window air conditioner by placing it in a window with the cooling portion on the interior and the heat discharge portion at the exterior, creating the additional problem of blocking a window. Similarly, freestanding unitary devices must be positioned so that an air discharge duct leads to the exterior of the room and allows heat to be discharged via the duct.

In contrast to unitary air conditioners, split air conditioners can provide for the interior cooling portion and the heat discharge assembly to be separated from one another in order to overcome some of the above noted issues. In various embodiments of split air conditioning systems, the noisiest portion of the air conditioning system can be placed outdoors in a location that is remote from the room to be cooled. One type of split air conditioner is a saddle mount air conditioner. A saddle mount air conditioner can include a low-profile service channel disposed between an indoor, air-cooling unit and an outdoor, heat discharging unit to permit air, condensate water, coolant, and electricity to pass between each unit. The service channel may be placed on the sill of a window so that the indoor unit and the outdoor unit straddle the sill such that they are significantly below the horizontal level of the sill. Other larger split units can require that, after installation of the interior and exterior units, connective piping be installed and charged with refrigerant. Such installations can require professional technicians to complete and charge the refrigerant piping, thereby greatly increasing the cost of the installation.

Even larger air conditioning systems can employ large chiller or cooling tower devices that serve to cool a working fluid at an exterior location. The working fluid can then be distributed to a heat exchanger to cool a secondary cooling loop or directly through a large piping network wherein flow is controlled to multiple zones to provide selective cooling at the end location. Such systems may provide multiple zone control but can require the permanent installation of a large and complex arrangement of pipes and automatic control valves.

In any of the above noted installations, in various examples there is very little an end user can do to service or reconfigure the air conditioning system. While a user may install and remove a window mount or unitary air conditioner, the problem of noise within the space exists in many embodiments. When opting for a split or chiller-based system the user must in some examples make due with the system as installed because of the large network of piping or the fact that the refrigerant lines contain high pressure refrigerant which must be handled by a licensed installer.

Still another difficulty some types of installations is that they lack significant control over the directionality of the cooling. While such devices have vanes or fins to direct the cooled air to some degree, the cooling is still limited to a region that surrounds the device. Since the installation of the device is fixed in various examples, either because the unit sits in a window or the interior portion of a split system is permanently affixed to a wall, redirection of the cooling effect is nearly impossible. In addition, such systems can be generally paired in a manner that provides a single cooling coil (evaporator) with a single heat dissipation coil (condenser) thereby eliminating the possibility of modularity or the addition of extra evaporators in connection with a single condenser and compressor.

In view of the above-described shortcomings associated with some examples of window and split system air conditioners, there is a need for a modular air conditioner that operates on the basic principle of a split system yet allows user serviceability and modular components such that the system is flexible. There is a further need for a modular air conditioning system that includes at least one indoor cooling unit that has an integrated cold store therein such that the temperature of the cold store is maintained by a circulating coolant fluid through hose connections with an outdoor heat dissipation unit.

In this regard, the present disclosure provides example embodiments of a modular air conditioner that operates on the basic principle of a split system yet allows user serviceability and modular components such that the system is flexible. Examples of modular air conditioning system are provided that is optimized for efficiently cooling the occupants of a room. The system in some embodiments includes an outdoor unit, at least one indoor unit and a user-serviceable hose that extends between the outdoor and indoor units. The outdoor unit can contain a compressor, an air-cooled condenser, a coolant to fluid heat exchanger, a fan and various other components such as controls. The indoor unit can contain a fan, a fluid pump, a cold fluid storage tank and a fluid to air heat exchanger. A hose can be a detachable hose that includes three lumens therein that act as a cold fluid supply, a fluid return and wiring for power and control signals.

In an example of operation, the outdoor unit operates using a heat pump/air conditioning cycle to reduce the temperature of the coolant or working fluid, which in turn extracts heat from a circulating fluid via the coolant to fluid heat exchanger. The cooled circulating fluid can then be circulated, via the hose, between the outdoor and indoor units wherein the cooled fluid reduces the overall temperature of the cold fluid storage tank. When cooling is needed in the indoor space, cold fluid from the cold fluid storage tank is circulated through the fluid-to-air heat exchanger where the fan circulates room air across the heat exchanger producing a cooling effect. This arrangement can allow a room cooling function and the fluid cooling function to be decoupled from one another in a temporal sense in some embodiments such that the control system only operates the outdoor unit when the temperature of the circulating fluid rises above a certain set point.

To further enhance the modularity of the system, in various embodiments the indoor and/or outdoor units are arranged such that they include multiple hose connection points so that multiple indoor units can be connected to a single outdoor unit. Such connections may be made directly from each of the indoor units to the outdoor units or in a daisy chain arrangement. Additionally, the indoor unit may include such functionality as heat sensors and servo directed louvers to direct cooling airflow to hotspots in a room (e.g., room occupants). Further, in some embodiments the indoor unit may be configured to collect condensate and deposit it back into the cold fluid loop. The outdoor unit can then be configured in some embodiments to eject some fluid from the loop (e.g., should the fluid capacity of the loop be exceeded by the addition of condensate).

Accordingly, it is an object of various embodiments to provide a modular air conditioner that operates on the basic principle of a split system yet allows user serviceability and modular components such that the system is flexible. It is an object of various embodiments to provide a modular air conditioning system that includes at least one indoor cooling unit that has a detachable cold storage therein such that the temperature of the cold store is maintained by a circulating coolant fluid through hose connections with an outdoor heat dissipation unit. It is an object of various embodiments to provide a modular air conditioning system that includes at least one indoor cooling unit that has a detachable cold storage unit therein such that the cooling operation conducted by the indoor and outdoor units are temporally separated thereby allowing operation of the system at its highest efficiency.

These together with other objects, along with various features of novelty that characterize various embodiments, are pointed out with particularity in the claims annexed hereto and forming a part of this disclosure. For a better understanding of operating advantages and the specific objects can be attained in some examples, reference should be had to the accompanying drawings and descriptive matter in which there is illustrated at least one preferred embodiment.

Various embodiments can comprise, consist essentially of or comprise one or more of the following features:

A) An "outdoor" unit containing a compressor, air cooled condenser, coolant-to-fluid heat exchanger, cooling fan, and associated components.

B) A mounting bracket for the outdoor unit which can be mounted to the structure in a multiple of ways, including suspended like a saddle over the windowsill, or attached directly to a vertical or horizontal surface of the structure, mounted on the ground, or mounted on the floor inside the structure (e.g., could use it as a portable dual-hose AC in embodiments where the bracket has wheels and may include a sensor to tell the outdoor unit it is being used inside).

C) An indoor unit comprising, consisting essentially of, or consisting of one or more of a fan, fluid pump for circulating fluid through a hose to the "outdoor" unit, a user control panel, a removable insulated cold fluid storage tank, a fluid to air heat exchanger, servo-controlled louvers for directing airflow, and heat sensors. An insulated cold fluid storage tank can be attached at the base of the indoor unit in some examples, or can be removable. Servo-controlled louvers can be controlled by heat sensors in some embodiments, directing airflow at hot occupants of a room. A fluid-to-air heat exchanger of some examples can collect condensate and add it to the circulating cold fluid loop. For example, if the system exceeds fluid capacity, the excess can be ejected by the outdoor unit (e.g., when it is used outside).

D) A detachable three lumen hose containing a cold fluid send, a fluid return, and power/control signals. The indoor unit in some examples has a connection point to connect the hose. The outdoor unit in some examples has multiple connection points to connect a single or multiple indoor units. In various embodiments, hoses can be connected to each other to extend the overall length of a hose run.

E) A non-toxic low freezing point coolant fluid, for example, water mixed with polyethylene glycol.

F) A "demand" control system, which in some embodiments only runs the outdoor unit when the temperature of the circulating fluid rises above a set point, and can in some examples optionally control the speed of the compressor. The indoor unit in various embodiments can run continuously and modulate the speed of the fans or coolant fluid pump to increase or decrease the rate of heat exchange. This can allow a near-constant indoor temperature to be maintained in some examples without the temperature swings of various conventional on/off controllers. The control system in some embodiments can also contain intelligence to run "store cold" when it is most efficient to do so, (e.g., at night). The insulated cold fluid storage tank can be chilled to extra low temperatures for use later, for example when the outdoor and ambient temperatures are elevated.

Now referring to the drawings, embodiments of a modular climate control system are shown and generally illustrated in the figures. As can be seen in the example embodiment of FIG. 1, the modular climate control system can include at least one user-positionable interior unit 10 wherein the interior unit 10 includes a fluid-to-air heat exchanger 12 and a fan 14 to circulate air across the fluid to air heat exchanger 12, an exterior unit 16 including a fluid-to-fluid heat exchanger 18 and a system 20 for supplying a working fluid having a controlled temperature to a first side of the fluid to fluid heat exchanger 18 and a circulation hose 22 connected between a fluid side of the fluid to air heat exchanger 12 and a second side of the fluid to fluid heat exchanger 18, wherein the circulation hose 22 allows a circulating fluid to transport heat between the at least one interior unit 10 and the exterior unit 16. As will be discussed in more detail below, the circulating fluid is, in some embodiments, a non-toxic, user-serviceable fluid and the circulation hose 22 can be coupled to the at least one interior unit 10 and the exterior unit 16 in a releasable manner.

Various embodiments can provide a modular air conditioning system that is optimized for efficiently cooling the occupants of a room. Turning to the example exterior unit 16 in more detail, the exterior unit can contain a system 20 for controlling the temperature of a working fluid. The system 20 for controlling the temperature may be a heat pump or a traditional compressor. In various cases of a heat pump, the system 20 can provide, add or remove heat to/from the working fluid. In contrast, in some examples where only a traditional compressor is provided, the system 20 removes heat from the working fluid. Further, the exterior unit 16 can include a fluid-to-fluid heat exchanger 18 that can allow the exchange of heat between the working fluid on one side of the heat exchanger 18 and the circulating fluid on the other side of the heat exchanger 18. A fan and various other components such as controls may also be included in the exterior unit 16.

The interior unit 10 can contain at least a fan 14 and a fluid to air heat exchanger 12. In some preferred embodiments, the interior unit 10 also includes a fluid pump and a circulating fluid storage tank that can operate as described below in more detail.

Figure 2:
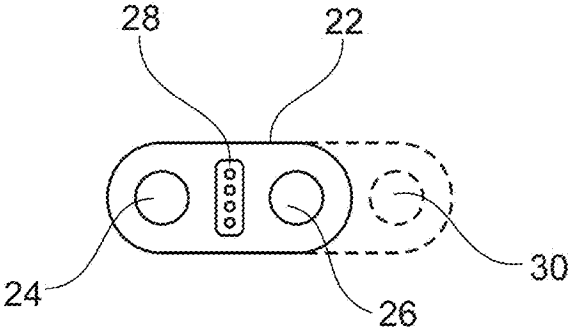
FIG. 2 is a cross section of the fluid tubing taken along line 2-2 of FIG. 1.

The circulation hose 22 can be a detachable hose that extends between the interior 10 and exterior units 16. For example, as can be seen in FIG. 2, the circulation hose 22 can include three lumens therein that act as a fluid supply 24, a fluid return 26 and wiring 28 for power and control signals between the interior 10 and exterior units 16. The circulation hose 22 may further optionally include a fourth lumen 30 to serve as a conduit to convey condensate back to the exterior unit 16 from the interior unit 10, which in some examples can prevent the need for a condensate drain therein.

It can be appreciated by one skilled in the art that within the scope of the present disclosure we have described an outdoor unit, however, it should be appreciated that the outdoor unit may be positioned indoors as well at a location wherein the user is not concerned about the potential for heat gain. Further, it is anticipated within the scope of the present disclosure that the air-cooled condenser may be a fluid cooled condenser, and more particularly, in some examples, a condenser that is cooled using ground source water.

Figure 3:
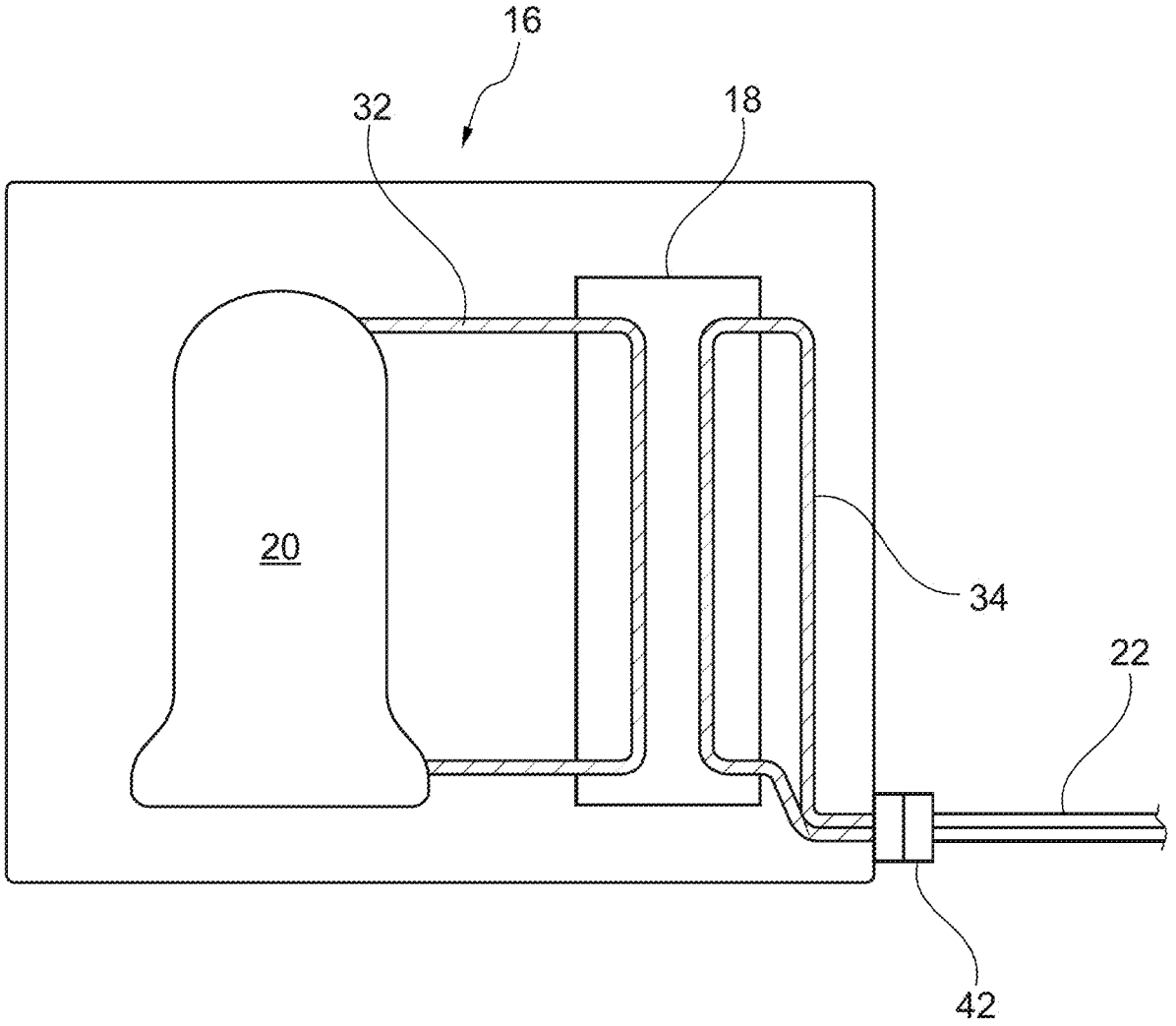
FIG. 3 is a schematic view of an exterior unit.

As illustrated in the example of FIG. 3, in operation the outdoor unit 16 can operate using a heat pump/air conditioning cycle to reduce the temperature of the working fluid 32 or coolant, which can in turn extracts heat from a circulating fluid 34 via the fluid-to-fluid heat exchanger 18.

Figure 4:
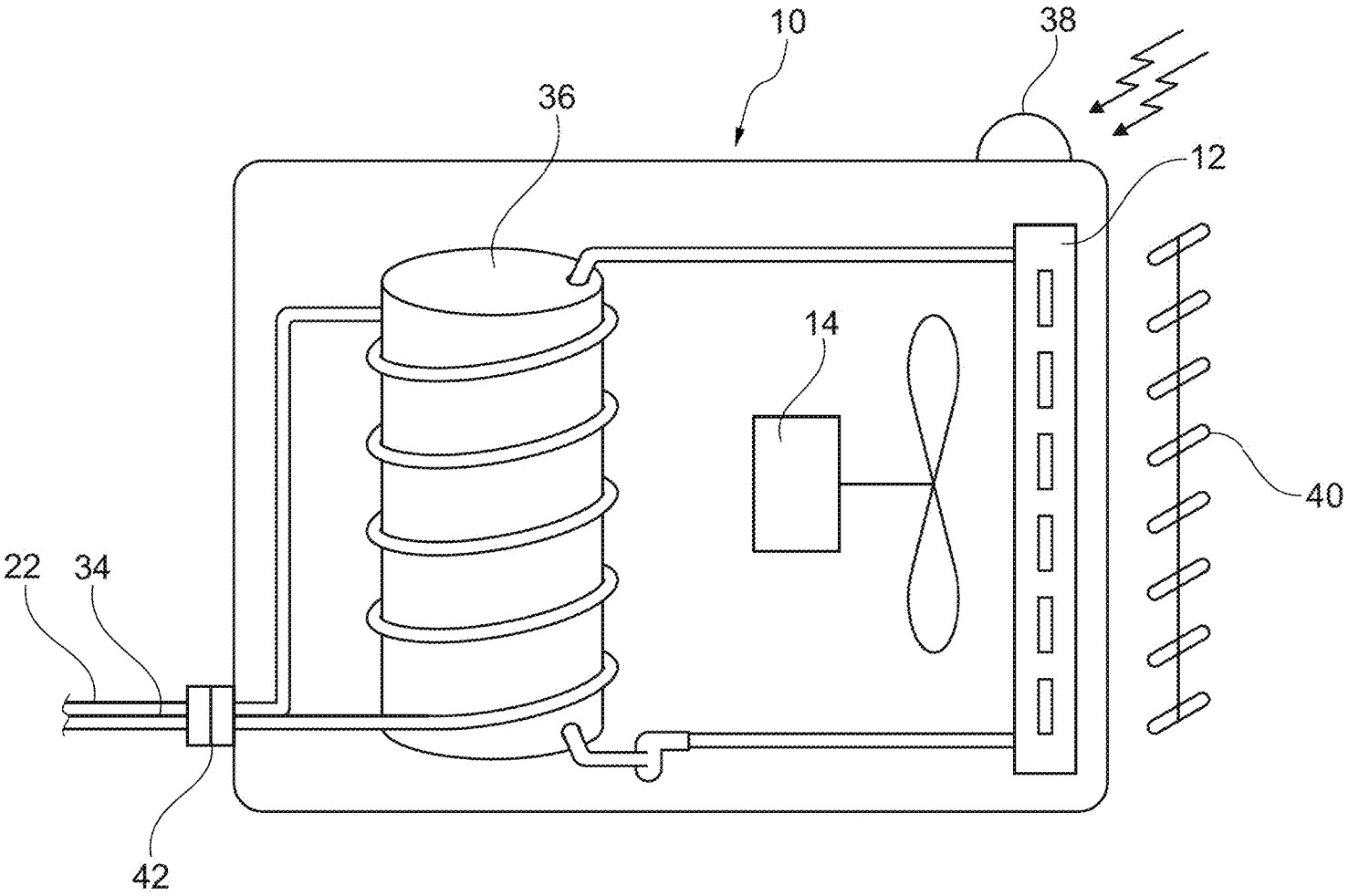
FIG. 4 is a schematic view of an interior unit.
Figure 6:
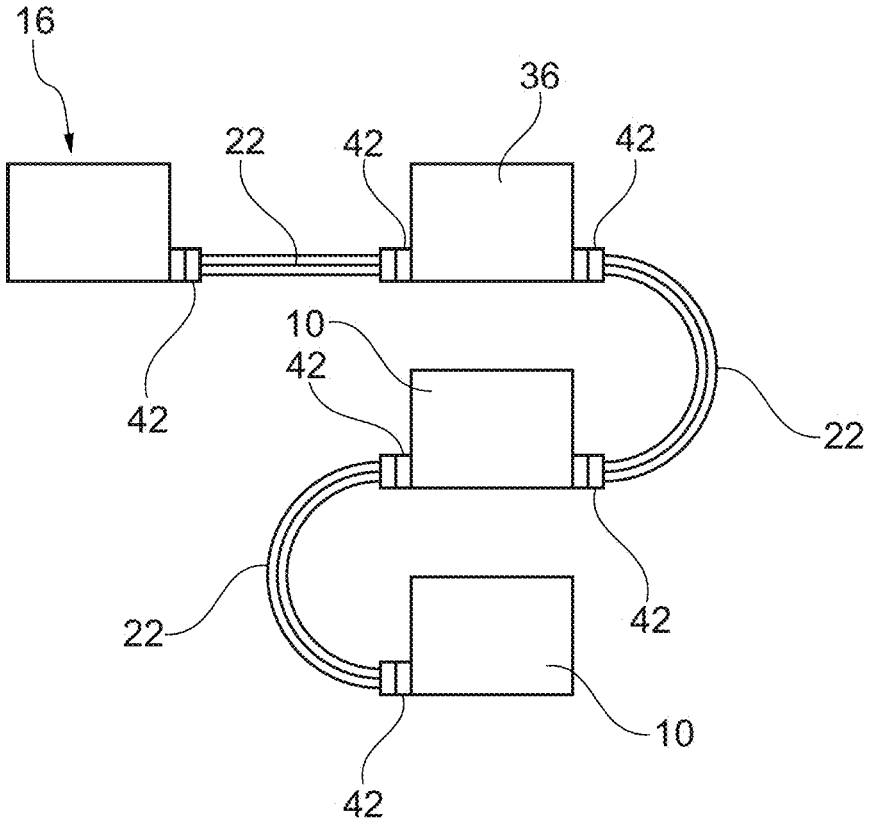
Figure 7:
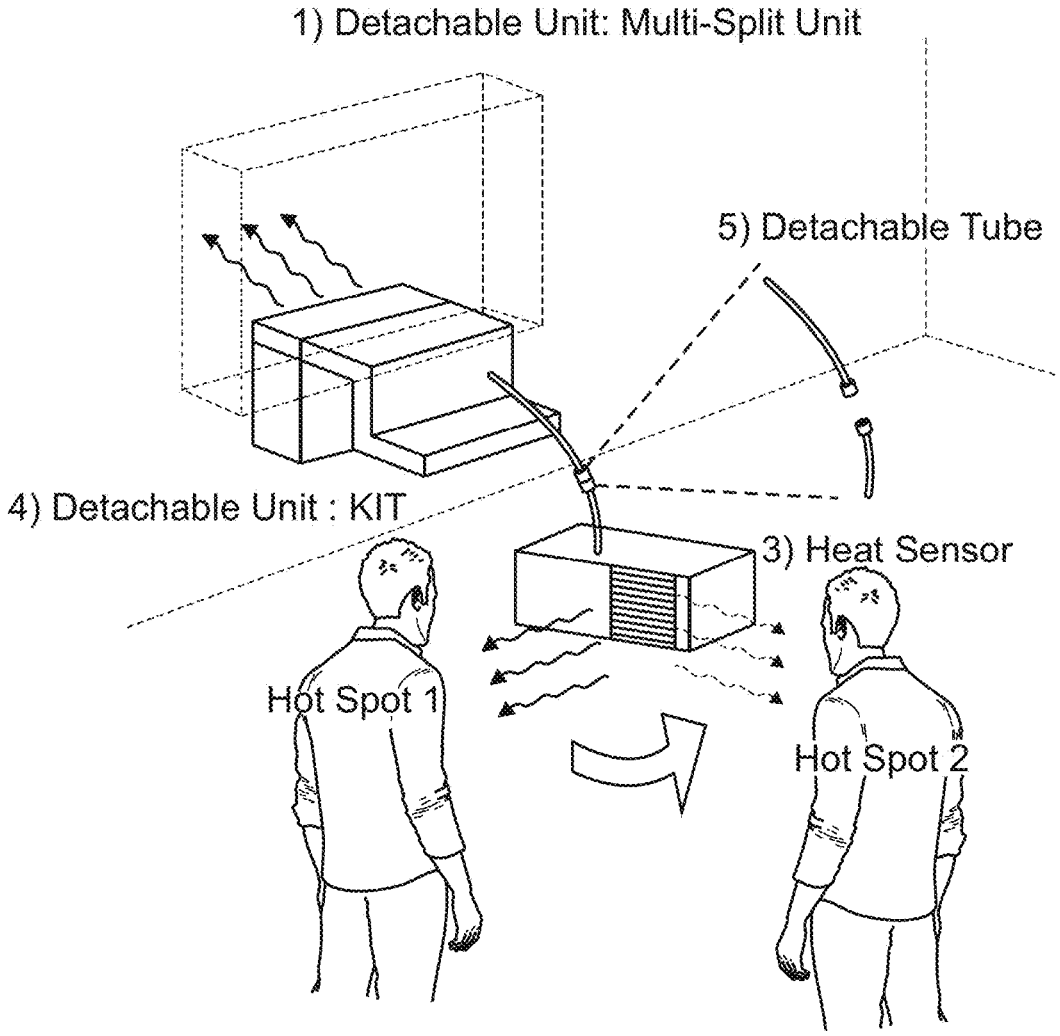
FIG. 7 illustrates an embodiment of a modular climate control system disposed in an opening of a room with two persons present in the room.
Figure 8:
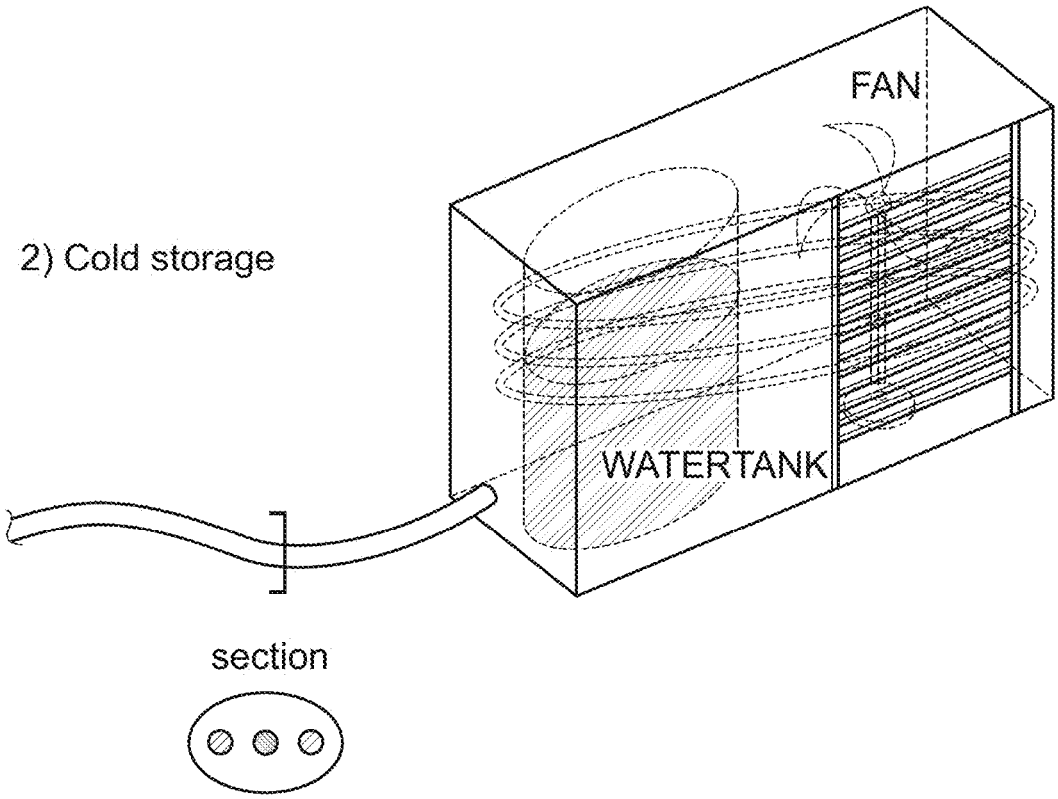
FIG. 8 illustrates a perspective view of an embodiment of a unit of a modular climate control system.

The cooled circulating fluid 34 can then be circulated, via the circulation hose 22, between the exterior 16 and interior 10 units. As was illustrated in the example of FIG. 1, the circulating fluid 34 may be directed through the fluid to air heat exchanger 12 in the interior unit 18 to cool the air directly. Further, as can be seen in the example of FIG. 4, the circulating fluid 34 may be directed to reduce the overall temperature of a fluid storage tank 36 within the interior unit 10. In such an embodiment, when cooling is needed in the indoor space, cold fluid from the cold fluid storage tank 36 can be circulated through the fluid-to-air heat exchanger 12 where the fan 14 circulates room air across the heat exchanger 12, producing a cooling effect. One skilled in the art should appreciate that while the fluid storage tank 36 is shown in the interior unit 10, it could also be positioned within the exterior unit 16 or independently at an intermediate position along the circulation hose 22 as depicted in FIG. 6. This arrangement, in various embodiments, allows the room cooling function and the fluid cooling function to be decoupled from one another in a temporal sense in that the control system only operates the outdoor unit when the temperature of the circulating fluid rises above a certain set point. Similarly, the indoor unit in some examples can independently increase or decrease fan speed and fluid circulation rate in order to provide a great deal of control over the cooling effect as compared to the prior art on-or-off cooling systems. This decoupling of the indoor cooling loop and the outdoor cooling loop can further allow the outdoor unit to cool the fluid when it is most efficient to do so. For example, the outdoor unit may cool the fluid stored in the interior insulated cold fluid storage tank at night for cooling use during the day when the outdoor ambient temperatures increase. It is accordingly an object of some embodiments to provide a modular air conditioning system that temporally decouples the cooling of a chilled-fluid loop and to provide for the cooling of the room in a manner that greatly improves the operating efficiency of the entire system.

It is of further note that the circulating fluid in some embodiments can be a non-toxic, low freezing point coolant such as salt brine of water mixed with polyethylene glycol. This can be contrasted with various prior art systems that can circulate a refrigerant such as Freon or R-10 between indoor and outdoor units. The arrangement of various embodiments can allow a user to selectively connect an indoor unit with an outdoor unit using a modular hose arrangement thereby eliminating a great deal of complexity and cost. Further, in various examples, such an arrangement can allow for freedom in placing the indoor unit as need for maximum cooling effect and occupant comfort. In some embodiments, the circulation hoses 22 are attached to the indoor 10 and outdoor 16 units using a quick release style coupler 42. In various examples, such quick release couplers 42 can include a valving therein that prevents leakage of circulating fluid 34 when the circulation hoses 22 are disconnected.

Figure 5:
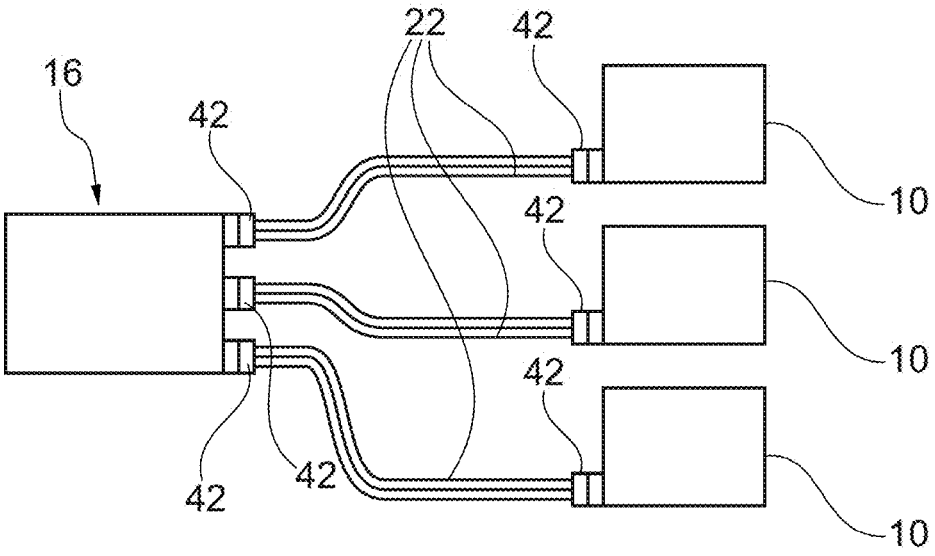
FIGS. 5 and 6 are illustrations showing various configurations of interior and exterior units.

To further enhance the modularity of the system in some embodiments, the indoor and/or outdoor units can be arranged such that they include multiple hose connection points so that multiple indoor units can be connected to a single outdoor unit. Such connections may be parallel or made directly from each of the indoor units 10 to the outdoor unit 16 as shown in the example of FIG. 5. Alternately, the indoor units 10 may be connected in series or in a daisy chain arrangement with the outdoor unit 16 as shown in the example of FIG. 6. Turning back to FIG. 4, the indoor unit 10 may include such functionality as heat sensors 38 and servo directed louvers 40 to direct cooling airflow to hot-spots in a room (e.g., room occupants). Further, in some embodiments, the indoor unit 10 may be configured to collect condensate and deposit it back into the circulating fluid 34 loop. The outdoor unit 16 in various examples can then be configured to eject some fluid from the loop should the fluid capacity of the loop be exceeded by the addition of condensate.

It should be further appreciated by one skilled in the art that the arrangement of the present disclosure could operate equally well as a heating system. In operation, in some embodiments the only change that would need to be made is that the outdoor unit would be run as a heat pump rather than as an air conditioner. In this manner rather than cooling the circulating fluid, the outdoor would heat the circulating fluid. Optionally, the indoor units may instead include a supplemental heating arrangement such as an electrical heating coil.

The present disclosure provides embodiments of a modular air conditioner that operates on the basic principle of a split system yet allows user serviceability and modular components such that the system is flexible. Further the present disclosure provides embodiments of a modular air conditioning system that includes at least one indoor cooling unit that has an integrated cold storage therein such that the temperature of the cold store is maintained by a circulating coolant fluid through user serviceable hose connections with an outdoor heat dissipation unit. For these reasons, various embodiments represent a significant advancement in the art, which has substantial commercial merit.

While there is shown and described herein certain specific structure embodying various examples, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

Embodiments of the disclosure can be described in view of the following description clauses:

A modular air conditioner is provided that operates on the basic principle of a split system yet allows user serviceability and modular components such that the system is flexible. The system in some examples generally includes an outdoor unit, at least one indoor unit and a user serviceable hose that extends between the outdoor and indoor units. The outdoor unit can contain a compressor, an air-cooled condenser, a coolant to fluid heat exchanger, a fan and various other components such as controls. The indoor unit can contain a fan, a fluid pump, a cold fluid storage tank and a fluid-to-air heat exchanger. The hose can be a detachable hose that includes three lumens therein that act as a cold fluid supply, a fluid return and wiring for power and control signals.

Various embodiments can be defined by one or more of the following clauses:

1. A modular climate control system comprising:
at least one user positionable interior unit, said interior unit including a fluid to air heat exchanger and a fan to circulate air across said fluid to air heat exchanger;
an exterior unit including a fluid-to-fluid heat exchanger and a system for supplying a working fluid having a controlled temperature to a first side of said fluid to fluid heat exchanger; and a circulation hose connected between a fluid side of said fluid to air heat exchanger and a second side of said fluid to fluid heat exchanger, said circulation hose allowing a circulating fluid to transport heat between said at least one interior unit and said exterior unit, wherein said circulating fluid is a non-toxic, user serviceable fluid and wherein said circulation hose is coupled to said at least one interior unit and said exterior unit in a releasable manner.

2. The modular climate control system of clause 1, wherein said system for supplying a working fluid is a heat pump and said working fluid is a refrigerant.

3. The modular climate control system of clause 2, wherein said heat pump can heat or cool said working fluid which in turn heats or cools said circulating fluid.

4. The modular climate control system of clause 3, said interior unit further comprising: a fluid storage reservoir therein to store heated or cooled working fluid until required.

5. The modular climate control system of clause 4, wherein said interior unit includes a condensate pump that deposits condensate into said fluid storage reservoir.

6. The modular climate control system of clause 1, wherein said system for supplying a working fluid is an air conditioning compressor and said working fluid is a refrigerant.

7. The modular climate control system of clause 6, wherein said air conditioning compressor cools said working fluid which in turn cools said circulating fluid.

8. The modular climate control system of clause 7, said interior unit further comprising: a fluid storage reservoir therein to store cooled working fluid until required.

9. The modular climate control system of clause 8, wherein said interior unit includes a condensate pump that deposits condensate into said fluid storage reservoir.

10. The modular climate control system of clause 1, wherein said circulating fluid is selected from the group consisting of: brine, water and glycol.

11. The modular climate control system of clause 10, wherein said circulation hose includes a first lumen to supply circulating fluid to said interior unit a second lumen to return circulating fluid to said exterior unit and a third lumen to provide power to said interior unit.

12. The modular climate control system of clause 11, wherein said interior unit includes a condensate pump and said circulation hose includes a fourth lumen to transport condensate to said exterior unit.

13. The modular climate control system of clause 11, wherein said circulation hose is affixed to said interior and exterior units using modular quick release connectors.

14. The modular climate control system of clause 13, wherein said quick release connectors include valves therein to contain said circulating fluid when said circulation hose is disconnected.

15. The modular climate control system of clause 1, further comprising:
a plurality of interior units interconnected to said exterior unit by a plurality of connection hoses.

16. The modular climate control system of clause 15, wherein said interior units are connected in series.

17. The modular climate control system of clause 15, wherein said interior units are connected in parallel.

18. The modular climate control system of clause 15, wherein said circulation hoses are affixed to said interior and exterior units using modular quick release connectors.

19. The modular climate control system of clause 18, wherein said quick release connectors include valves therein to contain said circulating fluid when said circulation hose is disconnected.

20. The modular climate control system of clause 1, wherein said at least one interior unit includes a fluid storage reservoir.

What is claimed is:

1. A climate control system coupled within an open window of a building, with the window separating an indoor area within the building and an outdoor area external to the building, the climate control system straddling a sill of the window and consisting essentially of:

an interior unit disposed at the window within the indoor area below a horizontal level of the sill, the interior unit including:

a fluid-to-air heat exchanger, a fan to circulate air across the fluid-to-air heat exchanger;

one or more heat sensors; and one or more servo-controlled louvers;

an exterior unit disposed at the window in the outdoor area below the horizontal level of the sill, the exterior unit including:

a fluid-to-fluid heat exchanger, and a system for supplying a working fluid that undergoes a pressure drop to cool the working fluid, the working fluid within a first circulation loop, the cooled working fluid being directed to a first side of the fluid-to-fluid heat exchanger;

a mounting bracket for at least the exterior unit the mounting bracket mounted to the sill of the window suspended like a saddle straddling the sill of the window and engaging a vertical or horizontal surface about the sill of the window;

no more than a single unitary circulation hose that extends through the window and over the sill to connect the exterior unit and the interior unit, the circulation hose connected between a fluid side of the fluid-to-air heat exchanger and a second side of the fluid-to-fluid heat exchanger, the circulation hose allowing a circulating fluid, that is maintained separate and apart from the working fluid, within a second circulation loop, to transport heat between the interior unit and the exterior unit such that cooling of the working fluid and cooling of the circulating fluid are temporally decoupled from one another; and a controls system configured to:

identify a location of one or more hot human occupants within the indoor area within the building based at least in part on sensor data from the one or more heat sensors; and actuate the one or more servo-controlled louvers to specifically direct cooling airflow generated by the interior unit to the location of the one or more hot human occupants within the indoor area identified based at least in part on the sensor data from the one or more heat sensors; and operate a room cooling function of the interior unit and a fluid cooling function of the exterior unit that are decoupled from one another in a temporal sense such that:

the controls system only operates the fluid cooling function of the exterior unit when the temperature of the circulating fluid rises above a certain set point; and the interior unit increases and decreases fan speed and fluid circulation rate as part of the room cooling function independently from the fluid cooling function of the exterior unit including independent of whether the fluid cooling function of the exterior unit is operating or not.

2. The climate control system of claim 1, wherein the single unitary circulation hose comprises:

a first lumen to supply circulating fluid to the interior unit, a second lumen to return circulating fluid to the exterior unit, a third lumen having wiring to provide power and control signals between the interior unit and exterior unit; and fourth lumen to convey condensate to the exterior unit from the interior unit.

3. The climate control system of claim 2, wherein the interior unit is configured to collect condensate and deposit it back into the first circulation loop via the fourth lumen conveying the collected condensate to the first circulation loop of the exterior unit from the interior unit; and wherein the exterior unit ejects a portion of fluid from the first circulation loop based at least in part on a determination that a fluid capacity of the first circulation loop has been exceeded by the addition of condensate.

4. The climate control system of claim 1, wherein the exterior unit is configured for a plurality of separate interior units to be operably coupled with the exterior unit in parallel via a plurality of respective hose connection points, with each of the plurality of separate interior units comprising:

a fluid-to-air heat exchanger, and a fan to circulate air across the fluid-to-air heat exchanger.

5. The climate control system of claim 1, wherein the interior unit is configured to couple with a plurality of additional interior units, including a second interior unit and a third interior unit, in series in a daisy chain arrangement, the second interior unit and a third interior unit each comprising:

a fluid-to-air heat exchanger, and a fan to circulate air across the fluid-to-air heat exchanger.

6. A climate control system coupled within an open window of a building, with the window separating an indoor area within the building and an exterior area external to the building, the climate control system straddling a sill of the window and comprising:

an interior unit disposed at the window within the indoor area below a horizontal level of the sill;

an exterior unit disposed at the window in the exterior area below the horizontal level of the sill; and a connector between the interior unit and the exterior unit that extends through the window and over the sill, the connector including:

a circulation hose that extends through the window and over the sill to connect the exterior unit and the interior unit, a mounting bracket for at least the exterior unit, the mounting bracket mounted to the sill of the window suspended like a saddle straddling the sill of the window; and a controls system configured to operate the interior unit and the exterior unit and configured to operate a room cooling function of the interior unit and a fluid cooling function of the exterior unit that are decoupled from one another in a temporal sense such that:

the controls system only operates the fluid cooling function of the exterior unit when the temperature of a circulating fluid of the exterior unit rises above a certain set point; and the interior unit increases and decreases fan speed and fluid circulation rate as part of the room cooling function independently from the fluid cooling function of the exterior unit including independent of whether the fluid cooling function of the exterior unit is operating or not.

7. The climate control system of claim 6, wherein the interior unit further comprises one or more heat sensors and one or more servo-controlled louvers; and wherein the controls system is further configured to:

identify a location of one or more hot human occupants within the indoor area within the building based at least in part on sensor data from the one or more heat sensors; and actuate the one or more servo-controlled louvers to direct cooling airflow generated by the interior unit to the location of the one or more hot human occupants within the indoor area identified based at least in part on the sensor data from the one or more heat sensors.

8. The climate control system of claim 6, wherein the circulation hose comprises:

a first lumen to supply circulating fluid to the interior unit, a second lumen to return circulating fluid to the exterior unit, and a third lumen having wiring to provide power and control signals between the interior unit and exterior unit.

9. The climate control system of claim 6, wherein the interior unit is configured to collect condensate and deposit it back into a first circulation loop of the exterior unit by conveying the collected condensate to the first circulation loop of the exterior unit from the interior unit; and wherein the exterior unit ejects a portion of fluid from the first circulation loop based at least in part on a determination that a fluid capacity of the first circulation loop has been exceeded by the addition of condensate.

10. The climate control system of claim 6, wherein the exterior unit is configured for a plurality of separate interior units to be operably coupled with the exterior unit in parallel via a plurality of respective hose connection points, with each of the plurality of separate interior units comprising:

a fluid-to-air heat exchanger, and a fan to circulate air across the fluid-to-air heat exchanger.

11. The climate control system of claim 6, wherein the interior unit is configured to couple with a plurality of additional interior units, including a second interior unit and a third interior unit, in series in a daisy chain arrangement, the second interior unit and a third interior unit each comprising:

a fluid-to-air heat exchanger, and a fan to circulate air across the fluid-to-air heat exchanger.

12. A climate control system coupled within an opening of a structure, with the opening separating an internal area within the structure and an exterior area external to the structure, the climate control system straddling the opening and comprising:

an interior unit disposed at the opening within the internal area;

an exterior unit disposed at the opening in the exterior area; and a connector between the interior unit and the exterior unit that extends through the opening, the connector including:

a circulation hose that extends through the opening to connect the exterior unit and the interior unit, and a controls system configured to operate the interior unit and the exterior unit and configured to operate a room cooling function of the interior unit and a fluid cooling function of the exterior unit that are decoupled from one another such that:

the controls system operates the fluid cooling function of the exterior unit when the temperature of a circulating fluid of the exterior unit rises above a certain set point; and the interior unit increases and decreases fan speed and fluid circulation rate as part of the room cooling function independently from the fluid cooling function of the exterior unit.

13. The climate control system of claim 12, wherein the interior unit further comprises one or more heat sensors and one or more movable louvers; and wherein the controls system is further configured to:

identify a location of one or more occupants within the internal area based at least in part on sensor data from the one or more heat sensors; and actuate the one or more movable louvers to direct cooling airflow generated by the interior unit to the location of the one or more within the internal area identified based at least in part on the sensor data from the one or more heat sensors.

14. The climate control system of claim 12, wherein the circulation hose comprises:

a first lumen to supply circulating fluid to the interior unit, a second lumen to return circulating fluid to the exterior unit, and a third lumen having wiring to provide power and control signals between the interior unit and exterior unit.

15. The climate control system of claim 12, wherein the interior unit is configured to collect condensate and introduce it back into a first circulation loop of the exterior unit; and wherein the exterior unit ejects a portion of fluid from the first circulation loop based at least in part on a determination that a fluid capacity of the first circulation loop has been exceeded by the introduction of the condensate.

16. The climate control system of claim 12, wherein the exterior unit is configured for a plurality of separate interior units to be operably coupled with the exterior unit in parallel via a plurality of respective hose connection points.

17. The climate control system of claim 12, wherein the interior unit is configured to couple with a plurality of additional interior units in series in a daisy chain arrangement.

* * * * *